United States Patent [19]

Lolli

[11] 4,145,961

[45] Mar. 27, 1979

[54] DIFFUSERS FOR AIR CONDITIONING EQUIPMENTS

[75] Inventor: Fabio Lolli, Rome, Italy

[73] Assignee: Lolli & C., S.p.A., San Cesareo (Rome), Italy

[21] Appl. No.: 807,411

[22] Filed: Jun. 17, 1977

[30] Foreign Application Priority Data

Jun. 23, 1976 [IT] Italy ..... 50104 A/76

[51] Int. Cl.[2] ..... F24F 13/10

[52] U.S. Cl. ..... 98/41 AV; 98/40 D

[58] Field of Search ..... 98/40 D, 40 B, 40 W, 98/41 AV

[56] References Cited

U.S. PATENT DOCUMENTS

| | | | |
|---|---|---|---|
| 2,125,454 | 8/1938 | Makshat et al. | 98/40 B |
| 2,736,255 | 2/1956 | Tutt et al. | 98/40 B |
| 2,958,272 | 11/1960 | Titus et al. | 98/40 B |
| 3,063,356 | 11/1962 | Fitt | 98/40 B |
| 3,103,869 | 9/1963 | Dry | 98/40 B |
| 3,155,027 | 11/1964 | Dayus | 98/40 B |

FOREIGN PATENT DOCUMENTS

| | | | |
|---|---|---|---|
| 447195 | 4/1949 | Italy | 98/41 AV |
| 567437 | 2/1945 | United Kingdom | 98/41 AV |
| 933915 | 8/1963 | United Kingdom | 98/40 B |

*Primary Examiner*—Ronald Feldbaum

*Attorney, Agent, or Firm*—Eyre, Mann, Lucas & Just

[57] ABSTRACT

A diffuser for air conditioning equipments comprising in combination a stationary outer casing, destined to be mounted at the outlet from the air duct, a shaped diffuser disc carried by a hub mounted by a quick coupling system inside of said casing and co-axial therewith, means for adjusting at will the position of said diffuser disc with respect to the stationary casing in order to adjust the direction of the air flow, and a cylindrical element controllably axially slidable between the diffuser and the stationary body, in order to adjust the rate of flow.

11 Claims, 8 Drawing Figures

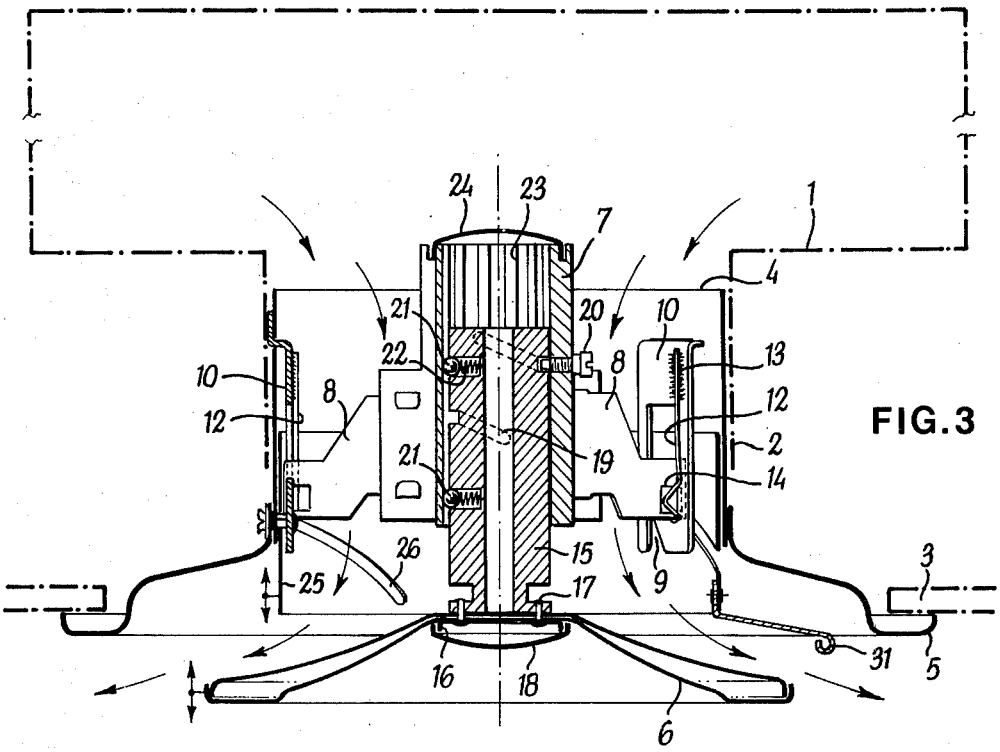
FIG.3
FIG.4
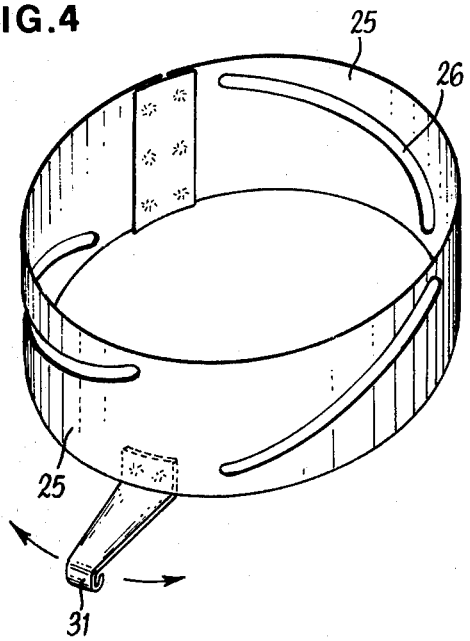
FIG.5
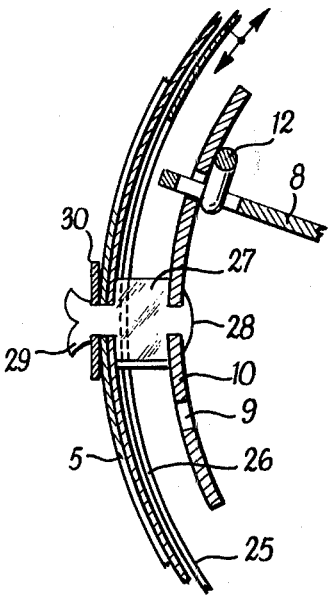

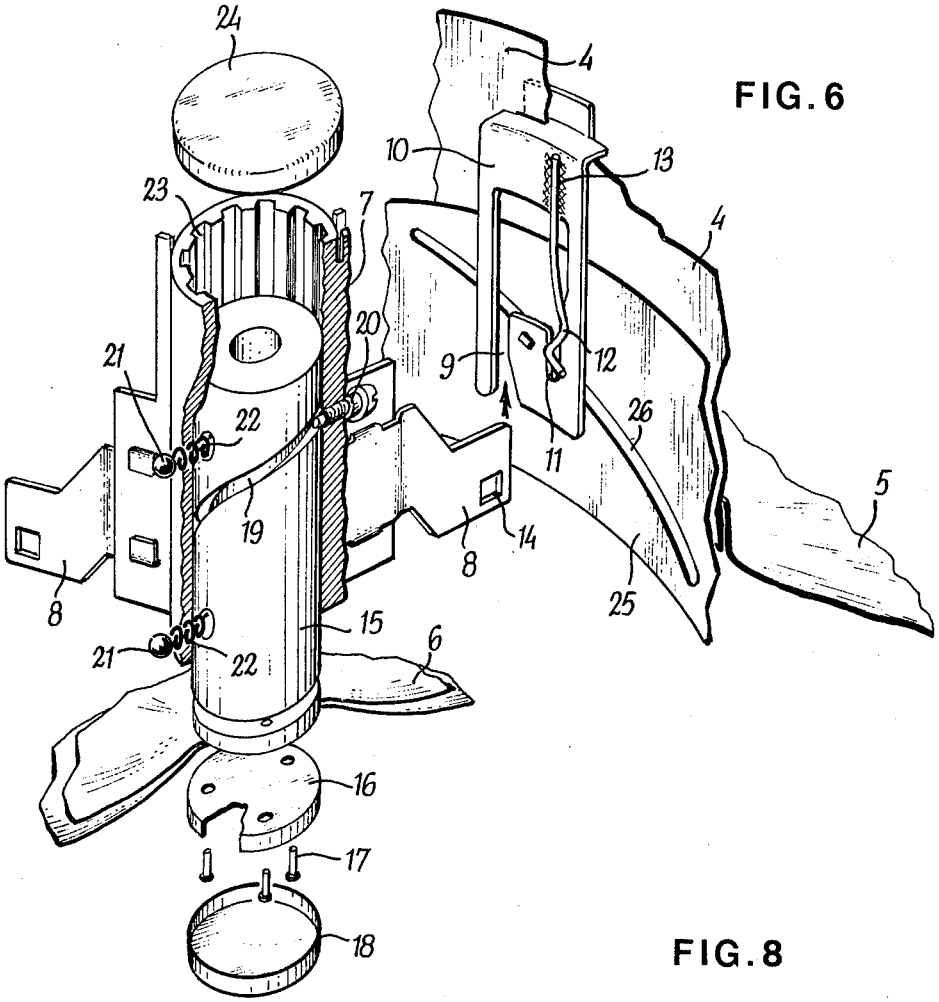
FIG. 6
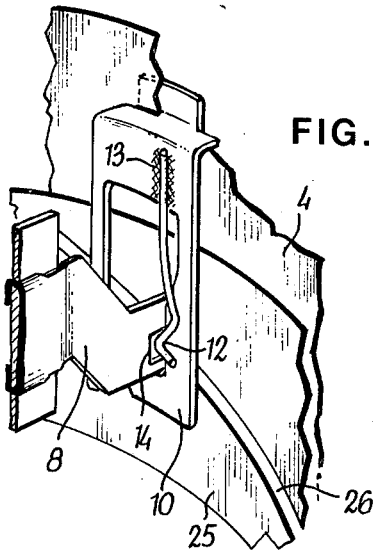
FIG. 7
FIG. 8
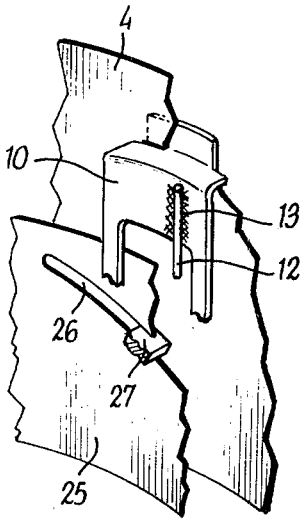

DIFFUSERS FOR AIR CONDITIONING EQUIPMENTS

The present invention relates to an improvement in the diffusers for air conditioning equipments. (Anemostats).

The purpose of this invention is that of embodying a device of the related kind, having easy and quick assembling, disassembling and adjusting characteristics, requiring the use of no tool, differently from those at present existing which require the use of suitable tools and the operation of which is difficult and time expensive.

Other features of the diffuser according to the present invention are its noiseless and its good aerodynamic efficiency.

According to this invention, a diffuser is provided comprising in combination, a fixed outer casing destined to be mounted at the outlet of the air duct, a shaped diffuser disc carried by a hub mounted by quick coupling device inside said casing and coaxial therewith, means for adjusting the position of said diffuser disc with respect to the stationary casing, in order to adjust the direction of the air flow, and a cylindrical element which can controllably slide between the diffuser and the stationary body in order to adjust the rate of the delivery of air flow.

Said means for the quick coupling of the diffuser disc to the cylindrical body of the casing consist of three radial arms, angularly equispaced, carried by said hub and soap inserted into corresponding seats pre-disposed in supports rigid with the cylindrical part of the casing, and co-operating with springs elastically urging said arms to their locked position.

This invention will be now described with reference to the attached drawings showing by way of non limitative example one preferred embodiment of the invention itself. In the drawings:

FIG. 3 is a sectional view taken along the line III—III of FIG. 1;

FIG. 4 shows the detail of the ring for adjusting the delivery rate, in perspective view;

FIG. 5 shows a sectional view taken along the line V—V of FIG. 2, in an enlarged scale;

FIG. 6 is an exploded view showing the system for quick assembling the central hub within the casing;

FIG. 7 shows the detail of one of the arms of the hub of FIG. 6 in its locked position;

FIG. 8 shows the detail of the guide for the ring for adjusting the rate of delivery.

Figure 1:
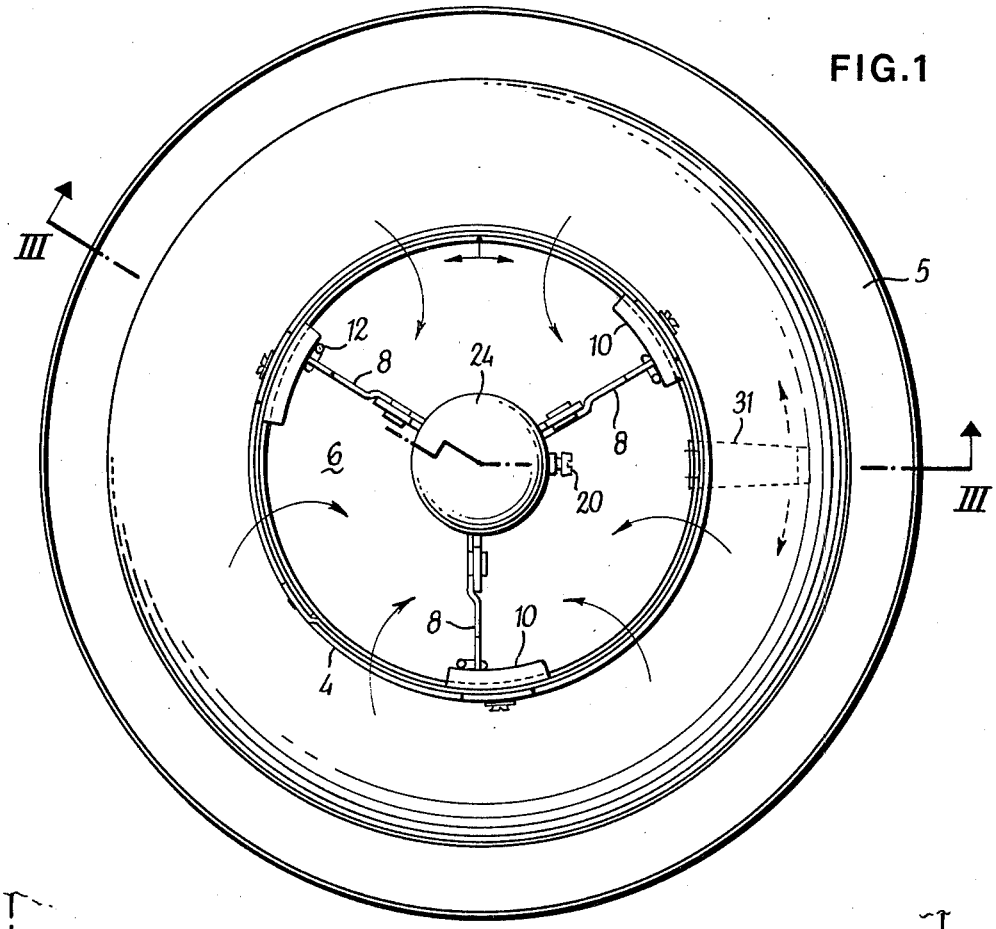
FIG. 1 shows the device according to this invention, seen from top downwards.
Figure 2:
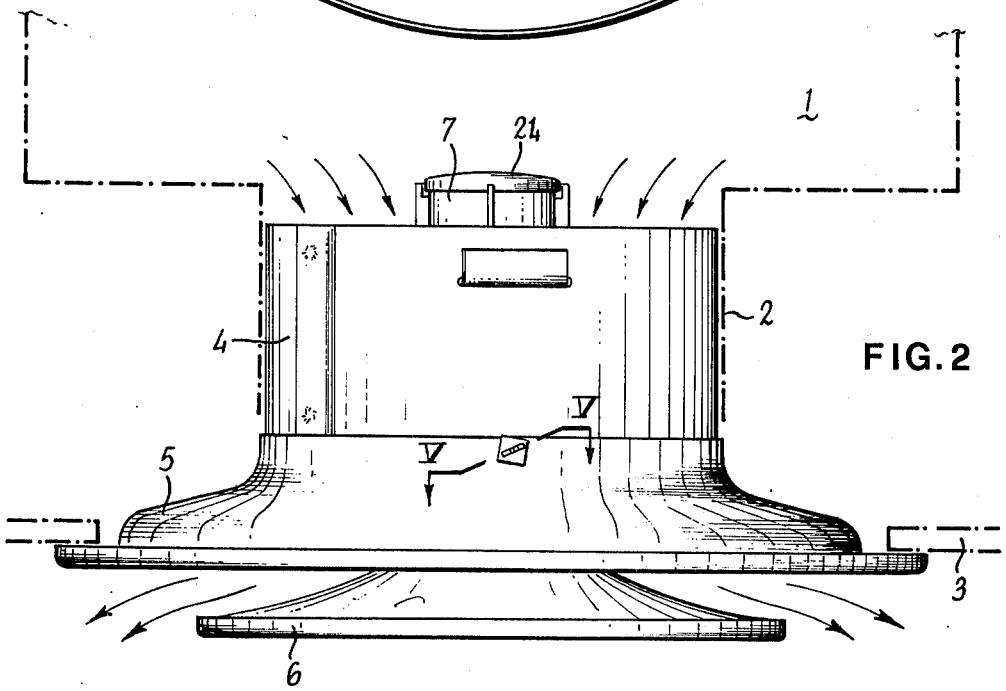
FIG. 2 shows a side elevational view.

With reference to FIGS. 1 to 3, the numeral reference denotes the air duct, 2 is the delivery passage, and 3 a structural element delimiting the room to which the air is destined. The device comprises a cylindrical casing 4, fixed by usual means to the passage 2 and ending by a stationary bell shaped element 5 which will be located against the element 3.

In said casing is mounted the diffuser disc 6 (see also FIG. 6) carried by the hub 7, by a quick coupling unit consisting of three arms 8 rigid with said hub, destined to be inserted into the slots 9 carried by the supporting tabs 10 fixed to the casing 4. The three arms 8, after being passed through the slots 9 are caused to rotate through a certain angle and are then pushed into the locking notches 11, where they are held by the springs 12 welded in 13 which are entered into the apertures 14 as shown in FIG. 7.

In order to disassemble the aforesaid unit it will be sufficient to carry out the cited operations in reverse order. As it will be evident from the above disclosure, the whole central block of the device is assembled and disassembled with the use of no tool in an easy and simple manner.

The diffuser disc 6 (FIGS. 3 and 6) is embodied with a double wall in order to remove any possibility of vibration and to obtain thus the maximum noiseless during the operation. It is fixed to the sleeve 15 by the washer 16 and the screws 17, covered by the lid 18. In order to adjust the distance of the diffuser disc 6 with respect to the stationary bell 5 and therefore the direction of the air flow, the sleeve 15 is provided with a helical groove 19 wherein is guided the screw 20 carried by the hub 7. The adjustment of the disc 6 will be made by manually rotating it, and a pair of ball stop elements 21 urged by the springs 22, bearing against the longitudinal grooves 23 of the hub, will define a set of positions of the disc itself. The upper end of the hub 7 is closed by a cover 24.

In order to adjust the rate of air flowing from the diffuser, (FIG. 4, 5 and 8) a ring element 25 is provided with helical slots 26 where are guided the members 27 one end 28 of which is riveted on the supporting tabs 10, while the other end 29 is riveted on the edge of the bell element 5 with the interposition of a spacer 30. A lateral arm 31 (FIGS. 3 and 4) allows the ring 25 to be rotated with respect to the casing and therefore to be axially slided in order to adjust the air rate.

The present invention has been described in a preferred embodiment thereof, but it will be understood that variations and modifications could be practically adopted without thereby departing from the scope of the present industrial privilege.

Having thus described the present invention, what is claimed is:

1. A diffuser for air conditioning equipment, comprising a stationary outer casing for mounting at the outlet from an air duct, a shaped diffuser disc mounted inside said casing and co-axial therewith, means for adjusting the position of said diffuser disc with respect to the stationary casing in order to adjust the direction of the air flow, and a cylindrical element separately controllably axially slidable independently of adjustment of said diffuser disc between the diffuser and the stationary body, said cylindrical element being operative to adjust the rate of flow.

2. A diffuser as claimed in claim 1, characterized in that said quick coupling means between the hub of the diffuser disc and the cylindrical body of the casing, consist of radial arms, angularly equispaced carried by the hub and snap inserted into corresponding seats predisposed in supports rigid with the casing and cooperating with springs which elastically hold said arms to their locking positions.

3. A diffuser as claimed in claim 2, characterized in that said supports for the arms consist of tabs carried by the cylindrical part of the casing, provided with a slot for the insertion of said arms, and a locking notch angularly displaced with respect to said slot, and co-operating with said springs.

4. A diffuser as claimed in claim 1, characterized in that said diffuser disc is embodied with a double wall and is connected to said hub by a sleeve rotatably mounted in the said hub, rigid with the disc, and provided with means suitable to determine the mutual rotation of the two elements and the consequent change of the position of the diffuser disc.

5. A diffuser as claimed in claim 4, characterized in that said rotation and sliding means of the sleeve with respect to the hub consist of helical groove provided in the sleeve, wherein it is guided by a screw mounted on the hub, and of a pair of ball stop elements pressed by springs and which snap into longitudinal grooves provided in the innerwall of the hub.

6. A diffuser as claimed in claim 1 characterized in that said rate adjusting ring is located co-axially with the cylindrical casing and its axial movement is controlled by a lever which determines the rotation of said ring, guided by helical slots into which enter members connecting the supports of the central body to the outer casing.

7. A diffuser for air conditioning equipment comprising an air delivery duct, a cylindrical casing in said air delivery duct, a stationary bell shaped element fastened with its upper end to said cylindrical casing, a hollow hub coaxially inserted into said cylindrical casing, support means for supporting said hub equidistantly from the inner wall of said casing, quick coupling means secured to said hub for coupling to said support means, a sleeve slidably arranged within said hollow hub and having a helical groove on its outer face, guide means through the wall of said hub and entering said helical groove, a diffuser disc fastened to the lower end of said sleeve, stop means provided in said sleeve and adapted to snap into seats provided on the inner wall of said hub as said sleeve is manually rotated for lowering or raising said diffuser disc to adjust the direction of the air flow, a ring shaped element arranged within said cylindrical casing between its inner wall and said support means and means for independently lowering and raising said ring element and thus adjusting the air flow rate.

8. A diffuser as claimed in claim 7, characterized in that said quick coupling means between the hub of the diffuser disc and the cylindrical body of the casing, consist of radial arms, angularly equispaced carried by the hub and snap inserted into corresponding seats predisposed in supports rigid with the casing and cooperating with springs which elastically hold said arms to their locking positions.

9. A diffuser as claimed in claim 8, characterized in that said supports for the arms consist of tabs carried by the cylindrical part of the casing, provided with a slot for the insertion of said arms, and a locking notch angularly displaced with respect to said slot, and cooperating with said springs.

10. A diffuser as claimed in claim 8, wherein said seats consists of a plurality of longitudinal grooves provided on the inner wall of said hub.

11. A diffuser as claimed in claim 7, wherein said means for lowing and raising comprises a plurality of equispaced helical slots, a plurality of equispaced fastening elements securing said support means to said casing and passing through said helical slots and a lateral arm fastened to the lower edge of said ring element.

* * * * *